US005983959A

United States Patent [19]

Germain et al.

[11] Patent Number: 5,983,959

[45] Date of Patent: Nov. 16, 1999

[54] HEAD FOR SUPPLYING A CRYOGENIC LIQUID, TRANSFER LINE AND SUPPLY PLANT EQUIPPED WITH SUCH A HEAD

[75] Inventors: Jean-Pierre Germain, Montigny le Bretonneux; Jean-Marie Disdier, Paris, both of France

[73] Assignee: L'Air Liquide, Paris, France

[21] Appl. No.: 09/110,970

[22] Filed: Jul. 7, 1998

[30] Foreign Application Priority Data

Jul. 7, 1997 [FR] France ..... 97 08589

[51] Int. Cl.[6] ..... B65B 1/04

[52] U.S. Cl. ..... 141/82; 141/5; 141/67

[58] Field of Search ..... 141/82, 67, 4, 141/5, 6, 39, 63, 64, 129, 156, 157; 53/431; 222/69

[56] References Cited

U.S. PATENT DOCUMENTS 4,407,340 10/1983 Jensen et al. .

FOREIGN PATENT DOCUMENTS 2496837 6/1982 France .
2688469 9/1993 France .
2092552 8/1982 United Kingdom .

*Primary Examiner*—Steven O. Douglas
*Attorney, Agent, or Firm*—Sixbey, Friedman, Leedom & Ferguson, P.C.; Robert M. Schulman

[57] ABSTRACT

A head (14) intended to be mounted on the end of a transfer line comprising a downstream outlet orifice (39) for liquid. The device comprises an insulating central nozzle (40) in which there is formed a through-opening (44, 45) for the passage of the liquid, an outer chassis (56, 58) surrounding the central nozzle (40) and in which the latter can slide, means (16) of securing the chassis and the transfer line (12) together, and means (84) of elastic return which, in service, press the upstream end (45) of the through-opening (44, 45) of the nozzle against the periphery (38) of the downstream orifice (39) of the transfer line (12). Application to the distribution of liquid nitrogen into cans of preserves.

11 Claims, 3 Drawing Sheets

HEAD FOR SUPPLYING A CRYOGENIC LIQUID, TRANSFER LINE AND SUPPLY PLANT EQUIPPED WITH SUCH A HEAD

BACKGROUND OF THE INVENTION (i) Field of the Invention

The present invention relates to a head for supplying a cryogenic liquid, which head is intended to be mounted on the end of a transfer line fed by a source of said liquid, said line comprising a downstream outlet orifice for said liquid.

(ii) Description of Related Art

Such transfer lines find applications in various fields of the art, particularly the food and pharmaceutical spheres, where it is necessary to deliver doses of cryogenic liquid, at a fairly high rate, and either continuously or discontinuously.

These lines are used, in particular, in order to deliver liquid nitrogen to containers containing foodstuffs, just before these containers are sealed. The purpose of this operation is, on the one hand, to pressurize, and therefore rigidify, the container, using the vaporization of the nitrogen which causes the container to inflate. This operation also allows the foodstuffs to be inerted by reducing the residual oxygen content and therefore allows the shelf life to be extended.

This operation of supplying cryogenic liquid is, however, particularly tricky and must be performed with extreme precision. This is because it is necessary for each container to receive the same, and most precise possible, amount of liquid so that the internal pressure will not vary from one container to another. If too little liquid is delivered to the containers, then these containers will deform during handling, and in particular, when stacked. By contrast, if they receive too much liquid, they will deform or even explode because the pressure they have inside them is then excessive.

The precision required for this operation of supplying cryogenic liquid is particularly difficult to achieve. In effect, the containers travel on a conveyor, usually at a very high and sometimes varying rate, which may be as much as several tens of containers per second.

An additional difficulty with this operation lies in the partial vaporization of the cryogenic liquid dispensed, which means that this liquid does not flow in a vertical and continuous jet as might be desired. Furthermore, this vaporization may lead to the formation of plugs of gas which cause the retention of cryogenic liquid, and thus discontinuous flow thereof.

SUMMARY AND OBJECT OF THE INVENTION

In order to alleviate these various drawbacks, the invention intends to produce a head for supplying cryogenic liquid, that can easily be fitted to a line for transferring said liquid, which meets the food hygiene requirements and is capable of delivering a clear-cut, constant and straight jet of cryogenic liquid.

For this purpose, the subject of the invention is a head for supplying cryogenic liquid of the aforementioned type, characterized in that it comprises:

- an insulating central nozzle in which there is formed a through-opening for the passage of the liquid;
- an outer chassis surrounding the central nozzle (40) and in which the latter can slide;
- means of securing the chassis and the transfer line together; and

- means of elastic return which, in service, press the upstream end of the through-opening of the nozzle against the periphery of the downstream orifice of the transfer line.

The supply head in accordance with the invention may have one or more of the following features:

- the upstream end of said through-hole is funnel-shaped, and the head further comprises a spherical endpiece defining said downstream orifice;
- said means of elastic return consist of a bellows formed by a thin and very long metal sheet folded several times on itself, a first end of which is fixed to an element secured to the central nozzle, and a second end of which is fixed to an element secured to the chassis;
- an insulating layer is arranged between the inner periphery of the chassis casing and the outer periphery of the nozzle;
- an insulating ring surrounding the nozzle is housed in a baseplate of the chassis which guides the lower end of the nozzle;
- as the head is intended to deliver cryogenic liquid to containers traveling along a conveyor, it comprises a cup for protecting the jet of liquid, the side wall of which cup surrounds the outlet of the nozzle and extends downstream of this outlet, in the direction of flow of the liquid;
- the head comprises a deflector for turning air away and for scraping, which has one end situated upstream of the outer periphery of said head, in the direction of travel of said containers, and the side wall of which extends downstream of the downstream orifice of the head, in the direction of flow of the liquid.

Another subject of the invention is a transfer line for cryogenic fluid, fed by a source of said cryogenic liquid, of the type comprising a central pipe for the passage of said liquid, and an outer casing, characterized in that it is equipped with a head as defined hereinabove.

The transfer line in accordance with the invention may have one or more of the following features:

- said outer casing and said chassis comprise opposing flanges, projecting outward, on which a clamping collar is arranged in order to fix said head to said line;
- an adapter ring and an O-ring seal are arranged between said flanges.

A final subject of the invention is a plant for supplying cryogenic liquid, of the type comprising a source of said liquid and at least one line for transferring this liquid, characterized in that the transfer line is in accordance with the definition hereinabove.

BRIEF DESCRIPTION OF THE DRAWINGS

The invention will be described hereinbelow with reference to the appended drawings which are given merely by way of example and in which.

DETAILED DESCRIPTION OF PREFERRED EMBODIMENTS

Figure 1:
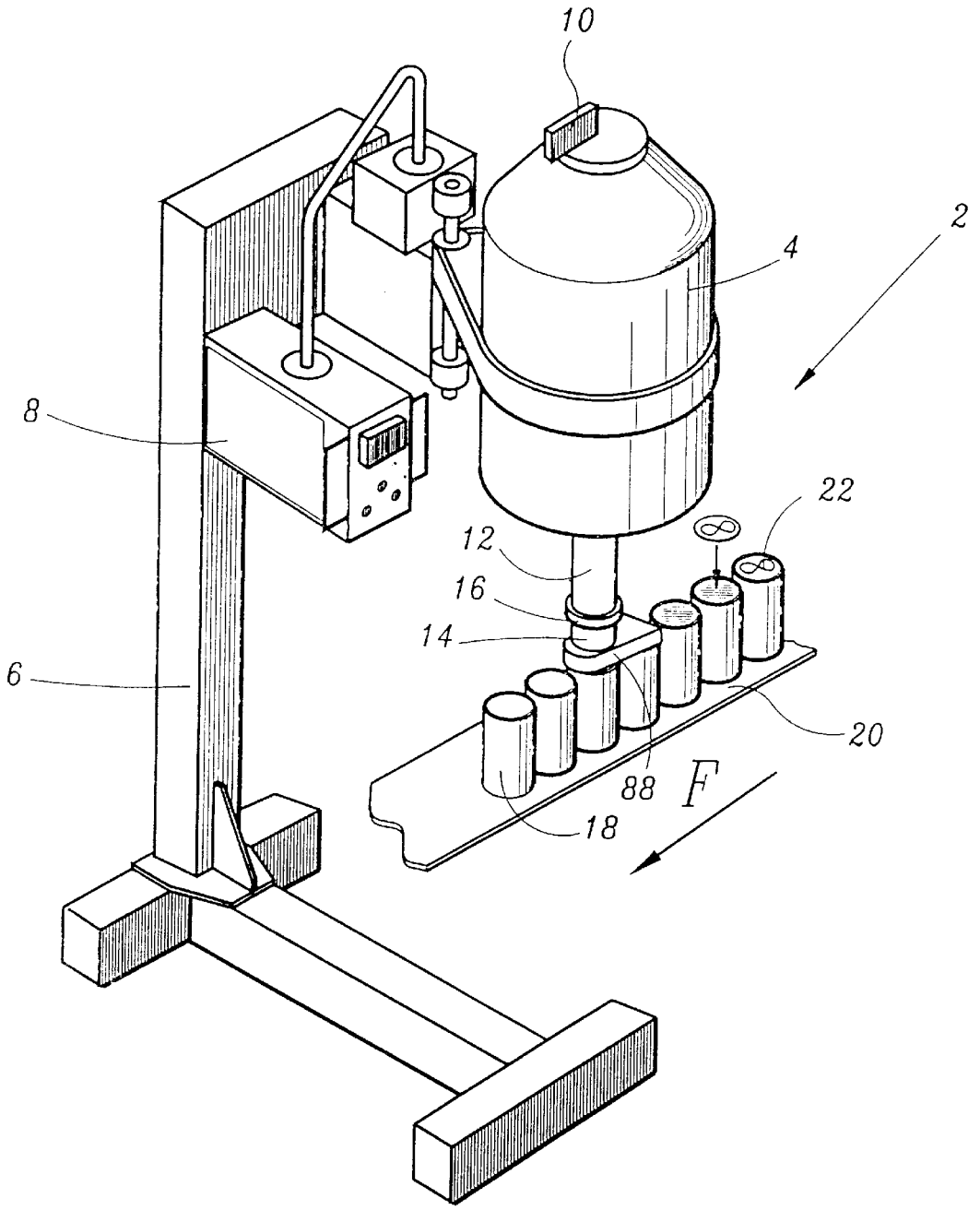
FIG. 1 is a view in perspective of a plant for supplying cryogenic fluid comprising a supply head in accordance with the invention.

FIG. 1 depicts a plant 2 for supplying a cryogenic liquid, in this case liquid nitrogen. This plant comprises a temporary storage reservoir 4, placed on a chassis 6. The reservoir 4 is fed with liquid nitrogen by a source, not depicted, and this feed is controlled by control means 8 which are, in themselves, known.

The storage reservoir comprises, at its top, a valve 10 allowing it to communicate with the outside, so that the pressure inside this reservoir is slightly higher than atmospheric pressure.

The reservoir 4 is extended, at its bottom end, by a transfer line 12 to which a supply head 14 in accordance with the invention is fitted by means of a clamping collar 16. These last three elements will be explained with reference to FIGS. 2 and 3.

The plant allows a predetermined amount of liquid nitrogen to be delivered to the insides of cylindrical preserving cans 18 traveling along a conveyor 20 in the direction of the arrow F. These containers contain, for example, fruit juice, and travel at a speed of several tens per second. The liquid nitrogen is delivered in the form of a continuous vertical jet.

After the desired amount of liquid nitrogen has been supplied to the inside of the container, a top lid 22 is attached to this container using any appropriate method, such as welding or crimping for example.

The liquid nitrogen thus delivered therefore, on account of its vaporization, on the one hand allows the container to be rigidified in order to avoid any deformation, and, on the other hand, allows the shelf life of the food product to be extended by inerting.

Figure 2:
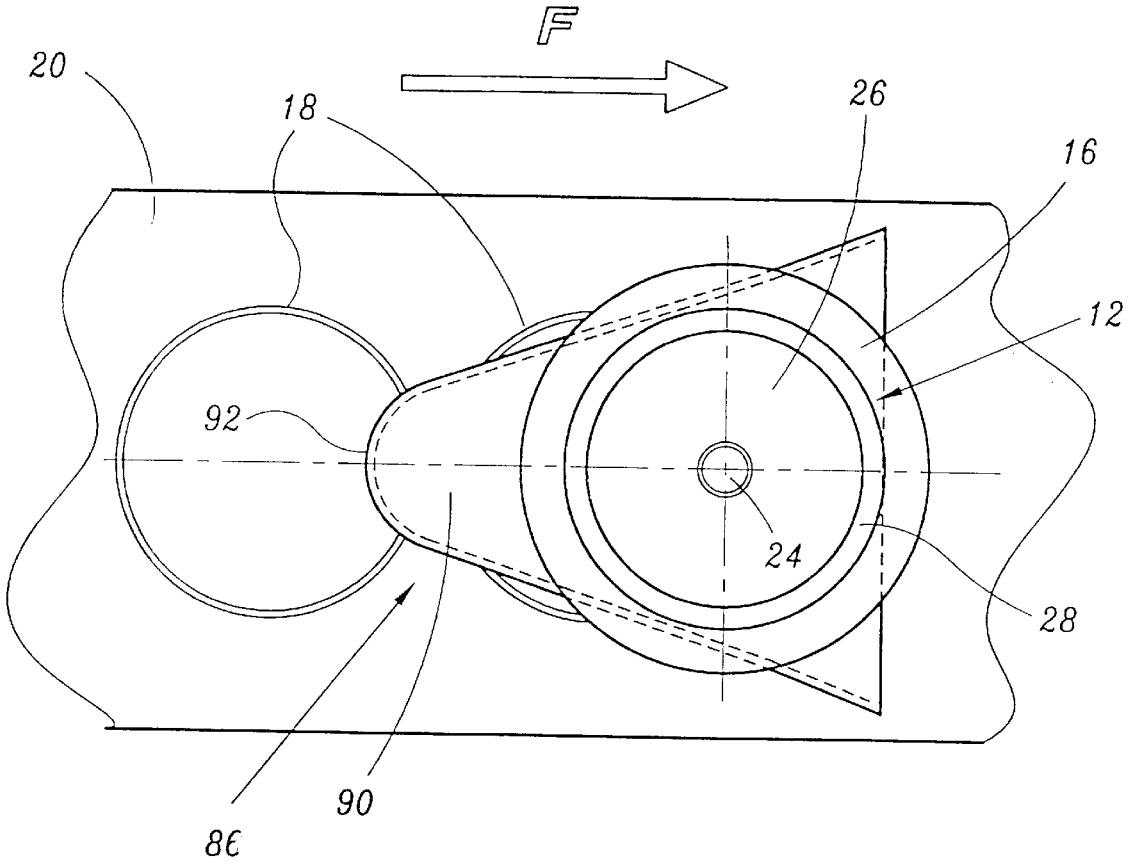
FIG. 2 is a view from above of a cryogenic liquid transfer line equipped with a supply head in accordance with the invention.
Figure 3:
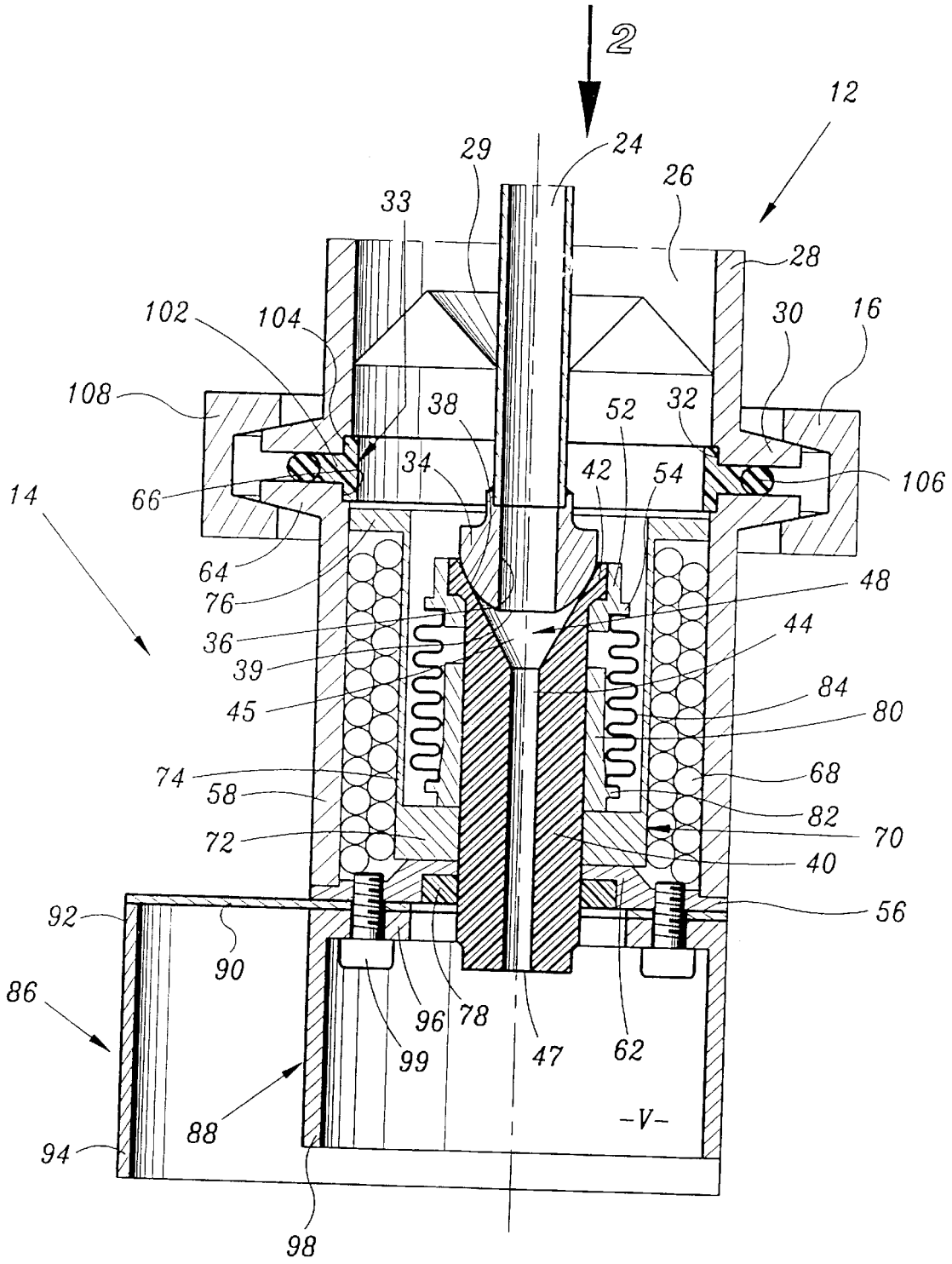
FIG. 3 is a sectional view on III—III of FIG. 2.

FIGS. 2 and 3 depict the transfer line 12 equipped with its terminal supply head 14.

This line 12 is of a type known per se and comprises a central pipe 24 made of stainless steel through which the liquid flows, and a sheath formed of an insulating covering 26 surrounding said pipe, as well as a peripheral casing 28, also made of stainless steel. The interwall space of the line 12 is under vacuum and is bounded, at the downstream end by a stopper 29.

The casing 28 is provided, at its downstream end, when considering the direction of flow of the liquid, with an external flange 30 projecting radially outward and intended to take the clamping collar 16 as will be described later.

The flange 30 comprises, at its internal periphery, a discontinuity 32 for accommodating an adapter ring 33, as will also be described later.

The pipe 24 extends beyond the stopper 29. It is extended by an endpiece 34 made of stainless steel and pierced with a central bore 36 for the passage of the liquid. This endpiece 34 has a domed external profile defined, in particular, by a hemispherical portion 38 extending from the periphery of the downstream orifice 39 of the bore 36. This orifice 39 defines the downstream orifice of the line 12.

The supply head 14 comprises a central nozzle 40 for dispensing the liquid, made of Teflon. Its outer periphery is approximately cylindrical and has an upper peripheral shoulder 42 projecting outward.

A through-hole for the passage of the liquid is made in the nozzle 40. This hole consists of a central duct 44 of circular section extended at its top by a frustoconical funnel 45 flaring toward the top of the nozzle. The downstream orifice 47 of the central duct 44 defines the downstream orifice of the supply head.

The nozzle 40 bears in a sealed and linear fashion, via its frustoconical wall 45, against the spherical surface of the endpiece 34 of the pipe 24 of the transfer line 12. Thus, the region 48 where liquid is transferred between the line 12 and the nozzle, which region lies immediately downstream of the downstream orifice 39 of the endpiece, is thermally well insulated and mechanically well isolated.

The peripheral shoulder 42 of the central member supports a peripheral flange 52 of corresponding profile which, at its lower part, has a rim 54 for taking a bellows, as will be described later.

The nozzle 40 is surrounded by a stainless steel chassis made up of a baseplate or bottom plate 56, of approximately circular external profile, and of a cylindrical peripheral casing 58 fixed to the baseplate by welding at the outer periphery of the latter.

The baseplate 56 comprises a thickened central region 62 in which a circular hole is made for the passage, with a small amount of clearance, of the nozzle 40.

The casing 58 at the upper part has a flange 64 projecting outward and provided with an internal discontinuity 66. This flange 64 and this discontinuity 66 are intended to interact with the corresponding flange 30 and corresponding discontinuity 32 of the casing 28 of the transfer line 12, as will be described later.

A layer 68 of insulating glass foam is arranged against the internal periphery of the casing 58 of the chassis, and rests against the baseplate 56. A lining piece 70 made of stainless steel covers the top and the interior of this insulating layer 68. This lining piece 70 comprises a base 72 welded to the thickened part 62 of the baseplate 56, a circular wall 74 extending along the inner periphery of the insulating layer 68, and a top rim 76 welded to the inner periphery of the casing 58.

A hole with a small amount of clearance for the passage of the central member 40 is also made in the base 72 of this lining piece 70.

An intermediate ring 78 made of Teflon is arranged in a lower counterbore of the baseplate 56, and surrounds the lower part of the nozzle 40 with a small amount of clearance. This ring 78 makes it possible to reduce the area available for heat exchange between the stainless steel baseplate 56 and the Teflon nozzle 40, so as to limit the amount of heat supplied to the cryogenic liquid flowing through the duct 44 of the central member.

A stainless steel guide sleeve 80 rests on the upper face of the base 70 of the lining piece, and surrounds the nozzle 40 over a substantial part of the height of the latter. At its bottom this sleeve 80 has a rim 82 projecting outward and to which there is welded the bottom end of a stainless steel bellows 84 formed of a thin and very long sheet folded several times on itself. The top end of this bellows is welded to the rim 54 of the peripheral flange 52 of the central member 40.

This bellows 84 therefore constitutes a means of elastic return allowing the frustoconical upper portion 45 of the nozzle 40 to be pressed, in service, against the endpiece 34 of the pipe 24 of the transfer line 12 so as to prevent any supply of heat to the liquid flowing.

The nozzle 40 is thus free to slide axially with respect to the chassis, which is fixed on the transfer line 12 as will be explained hereinbelow, and is guided by the internal surfaces of the sleeve 82 the base 72 of the lining piece 70, and the thickened part 62 of the baseplate 56, respectively.

This means of elastic return therefore makes it possible to avoid any differential expansion between the various elements that make up the line 12 and the head 14, which might lead to the endpiece 34 becoming detached from the nozzle 40, and thus to unwanted vaporization of the cryogenic liquid by the supply of heat.

A deflector 86 for turning away air and for scraping, and a cup 88 for projecting the jet of liquid nitrogen, are also attached to the lower face of the baseplate 56.

The deflector 86, which is made of stainless steel, consists of a basic plate 90 which, when viewed from above, is approximately V-shaped flaring in the downstream direction, when referring to the direction of travel of the containers 18 along the conveyor 20. This basic plate has a tip 92 projecting in the upstream direction with respect to the outer periphery of the casing 58 of the head 14.

The deflector 86 further comprises a side wall 94 extending vertically downward from the periphery of said main plate 90. This side wall 94 projects downward with respect to the downstream end of the duct 44 for the passage of the cryogenic liquid.

The shape of this deflector, projecting both downstream and downward, allows it to turn away the stream of air that is caused by the fast rate of movement of the containers 18 along the conveyor 20. It may also fulfill a scraping function with a view to eliminating any residual foam on the top of the containers before these containers are sealed, this making it possible thereby to avoid any plugging of the duct 44 of the head 12 by the foodstuffs contained in the containers 18.

The cup 88, which is made of Teflon, comprises a base 96 resting against the basic plate 90 of the stem post, and a side wall 98 extending downward. This side wall is of circular section and has approximately the same outside diameter as the head casing 58.

The side wall extends, downward, projecting from the downstream end of the duct 44 for the passage of the cryogenic liquid, but remains set back from the lower edge of the deflector motor 86. In this way, an atmosphere that is saturated with gaseous nitrogen builds up inside the volume of the V defined by the cup. This therefore prevents the surrounding air from coming close to the end of the duct, in the vicinity of which the temperature is well below 0°, and this eliminates any risk of the formation of ice due to the moisture in the air.

The deflector 86 and the cup 88 are respectively provided with a central orifice for the free passage of the central member 40, and are fixed in the same operation against the baseplate 56 of the chassis of the head, for example using screws 99.

The joint between the head 14 and the transfer line 12 will now be described. The Teflon adapter ring 33, in the shape of a crown, is arranged between the downstream end of the transfer line 12, and the upstream end of the supply head 14. This ring has a cross section in the shape of a T, the web 102 of which faces radially outward and is centered by its two arms 104, in the respective discontinuities 32, 66 with which the flanges 30, 64 are provided opposite the line 12 and the head 14. The web 102 is sandwiched between the opposing plane faces of the two flanges.

A O-ring seal 106 made of EPDM is also arranged at the outer periphery of the adapter ring 33, and is therefore crushed between the respective flanges 30, 64 of the line 12 and of the head 14 [sic].

The clamping collar 16, of approximately C-shaped cross section and made of stainless steel also squeezes the flanges 30 and 64 together, via the interior face of each of its arms 108.

A design of this kind makes it possible to limit the ingress of heat toward the cryogenic liquid, because the clamping element is not near the pipe 24 and the duct 44 for the passage of said liquid, but at the outer casings of the line 12 of the head 14 [sic].

The invention makes it possible to achieve the objectives mentioned previously.

Indeed, the supply head in accordance with the invention can easily be fitted to the transfer line, because their mutual attachment involves only easily removable elements. What is more, the user can bore out the duct 44 to the desired diameter himself.

The supply head in accordance with the invention meets the food-hygiene requirements, because it employs only materials such as stainless steel and Teflon which are compatible with the peracetic acid used for cleaning the plant. Furthermore, the path taken by the liquid nitrogen through the head has no hidden areas liable to cause possible retention of water or of any other product.

Finally, the head in accordance with the invention makes it possible to minimize the supply of heat to the cryogenic fluid. The connection between the transfer line and the supply head actually consists solely of elements which are attached at the outer casings of the line and of the head.

Furthermore, the area where the paths for the passage of liquid inside the line and inside the head respectively meet is thermally well insulated, first of all because of the use of a central nozzle made of an insulating material, and also thanks to the use of a means of elastic return that allows the upstream end of the central nozzle for the passage of the liquid to be pressed, in service, against the terminal endpiece of the transfer line, and finally, because of the profiles of the endpiece and of the nozzle.

We claim:

1. A head for supplying a cryogenic liquid adapted to be mounted on an end of a transfer line fed by a source of said liquid, said line comprising a downstream outlet orifice for said liquid, comprising:

an insulating central nozzle in which there is formed a through-opening for passage of the liquid;

an outer chassis surrounding the central nozzle in which the latter can slide;

means for securing the chassis and the transfer line together; and an elastic return which, in service, presses an upstream end of the through-opening of the nozzle against the periphery of the downstream orifice of the transfer line.

2. Head according to claim 1, wherein the upstream end of said through-hole is funnel-shaped, and the head further comprises a spherical endpiece defining said downstream orifice.

3. Head according to claim 2, wherein said elastic return comprises a bellows formed by a metal sheet folded several times on itself, a first end of which is fixed to an element secured to the central nozzle, and a second end of which is fixed to an element secured to the chassis.

4. Head according to claim 1, further comprising an insulating layer arranged between an inner periphery of the chassis casing and an outer periphery of the nozzle.

5. Head according to claim 1, further comprising an insulating ring surrounding the nozzle housed in a baseplate of the chassis which guides a lower end of the nozzle.

6. Head according to claim 1, further comprising a cup for protecting the liquid, said cup comprising a side wall which surrounds an outlet of the nozzle and extends downstream of this outlet, in the direction of flow of the liquid.

7. Head according to claim 1 for delivering cryogenic liquid to containers traveling in a direction along a conveyor comprising a deflector for turning air away and for scraping, which has one end situated upstream of an outer periphery of said head, in the direction of travel of said containers, and a side wall of which extends downstream of a downstream orifice of the head, in a direction of flow of the liquid.

8. Transfer line for cryogenic fluid, fed by a source of said cryogenic liquid, comprising a central pipe for passage of said liquid, and an outer casing wherein said transfer line, is equipped with a head according to claim 7.

9. Transfer line according to claim 8, wherein said outer casing and said chassis comprise opposing flanges, projecting outward, on which a clamping collar is arranged in order to fix said head to said line.

10. Transfer line according to claim 9 further comprising an adapter ring and an O-ring seal arranged between said flanges.

11. Plant for supplying cryogenic liquid comprising a source of said liquid and at least one line for transferring this liquid, comprising the transfer line of claim 8.

* * * * *